United States Patent [19]

Carrara

[11] Patent Number: 4,966,203

[45] Date of Patent: Oct. 30, 1990

[54] SEPARATOR STRUCTURE FOR GUIDING WEAVING LOOM HARNESS FRAMES

[75] Inventor: Elio Carrara, Cazzano Sant'Andrea, Italy

[73] Assignee: Lamiflex S.p.A., Ponte Nossa, Italy

[21] Appl. No.: 346,199

[22] Filed: May 2, 1989

[30] Foreign Application Priority Data

May 5, 1988 [IT] Italy ..... 20459 A/88
Nov. 10, 1988 [IT] Italy ..... 22581 A/88

[51] Int. Cl.[5] ..... D03C 9/06
[52] U.S. Cl. ..... 139/91
[58] Field of Search ..... 139/91, 92, 88; 220/22, 220/324

[56] References Cited

U.S. PATENT DOCUMENTS

| | | | |
|---|---|---|---|
| 3,250,421 | 5/1966 | Braun | 220/22 X |
| 3,283,915 | 11/1966 | Maslow | 220/22 X |
| 3,410,391 | 11/1968 | Kanter | 220/324 X |
| 3,901,282 | 8/1975 | Kramer et al. | 139/92 |
| 4,204,045 | 5/1980 | Kjellander et al. | 220/22 X |
| 4,366,843 | 1/1983 | Simizu | 139/91 |
| 4,372,445 | 2/1983 | Keffeler | 220/22 X |
| 4,375,863 | 3/1983 | Kappler | 220/22 X |
| 4,565,223 | 1/1986 | Hall | 139/91 |
| 4,741,441 | 3/1988 | Keffeler | 220/22 X |
| 4,815,623 | 3/1989 | Levin | 220/22 X |

*Primary Examiner*—Andrew M. Falik
*Attorney, Agent, or Firm*—Guido Modiano; Albert Josif

[57] ABSTRACT

The separator structure for guiding weaving loom frames comprises a pair of spaced-apart parallel plate-like elements joined to one another by at least one separate side member which extends along a portion of the periphery of the plate-like elements. Coupling formations are furthermore provided to stably join the plate-like elements and the side member. The coupling formations are defined by channels formed on the inner faces of the plate-like elements and by protrusions formed on the edges of the side member. The protrusions are complementarily shaped to the channels and engage therein. The separator structure is placed astride a weaving loom for guiding and preventing the weaving loom from bending during vertical movement thereof.

13 Claims, 2 Drawing Sheets

SEPARATOR STRUCTURE FOR GUIDING WEAVING LOOM HARNESS FRAMES

BACKGROUND OF THE INVENTION

The present invention relates to a separator structure for guiding weaving loom frames.

As known, separators are applied to weaving loom frames and have the function of preventing the frame from bending when it is raised with respect to the other frames so as to avoid that the same frame interferes with the other frames in its subsequent descending movement.

Frame separators have a substantially flattened configuration so as to define the actual guiding body and have two substantially plate-like portions which are arranged astride the frame so as to guide them in position.

Said separators must be very light and mechanically sturdy, and therefore used to be made of special woods with considerable constructive complications.

Wooden separators, however, have the disadvantage of being subject to rapid wear, with the consequent need to frequently replace them.

In order to try to obviate this disadvantage, separators have already been marketed which are substantially constituted by a pair of opposite plate-like elements, made of laminated plastic material, which are glued at one end to a body which is arranged at the guiding body and is made of rigid polyurethane or other plastic materials.

With respect to wood, such separators have greater resistance to wear, but they are very heavy, due to the mass of synthetic material which defines the guiding body, and are furthermore expensive to manufacture, since they entail a plurality of operative steps for assembling the laminated-plastic plate-like elements on the synthetic-material body.

Another disadvantage furthermore resides in the fact that as they are obtained by mutually glueing a plurality of component elements they generally present an unsatisfactory surface finishing.

SUMMARY OF THE INVENTION

The aim of the present invention is indeed to eliminate the above described disadvantages by providing a separator structure for guiding loom frames having a very high resistance to wear, since the plate-like elements which in practice define the surfaces of possible mutual scraping are made of laminated plastic but have, at the same time, considerable lightness characteristics.

Within the scope of the above described aim, a particular object of the invention is to provide a separator structure in which the stable coupling between the plate-like elements and the body can be provided at the guiding body in an effective and rapid manner.

Another object of the present invention is to provide a separator structure which has perfectly smooth and finished outer surfaces, thus contributing to an improved functionality of the assembly as well as to an improvement in its aesthetic characteristics.

Not least object of the present invention is to provide a separator structure which is simplified in manufacture and is furthermore competitive from a merely economical point of view.

The above described aim, the objects mentioned and others which will become apparent hereinafter are achieved by a separator structure for guiding loom frames, according to the invention, characterized in that it comprises a pair of spaced-apart parallel plate-like elements, joined by at least one border affecting a portion of a periphery defined by said plate-like elements, coupling means being furthermore provided to stably couple said plate-like elements and said border.

BRIEF DESCRIPTION OF THE DRAWINGS

Further characteristics and advantages will become apparent from the description of a preferred but not exclusive embodiment of a separator structure for guiding loom frames, illustrated only by way of non-limitative example in the accompanying drawings, wherein.

DESCRIPTION OF THE PREFERRED EMBODIMENTS

Figure 1:
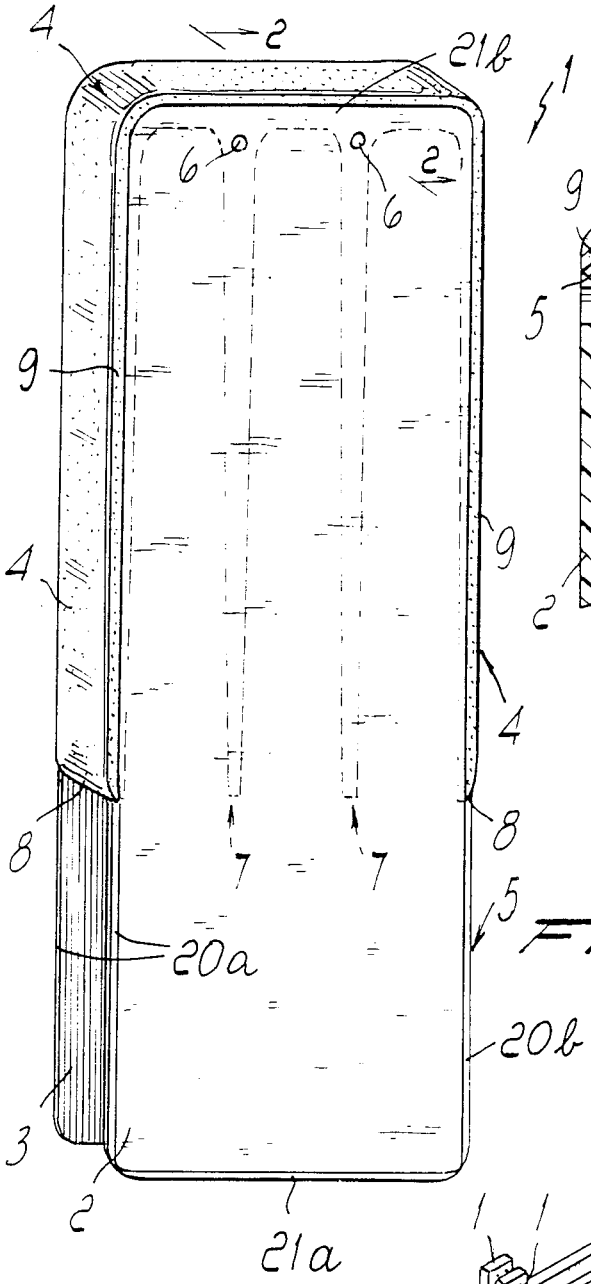
FIG. 1 is a schematic view of the separator structure according to the invention.
Figure 2:
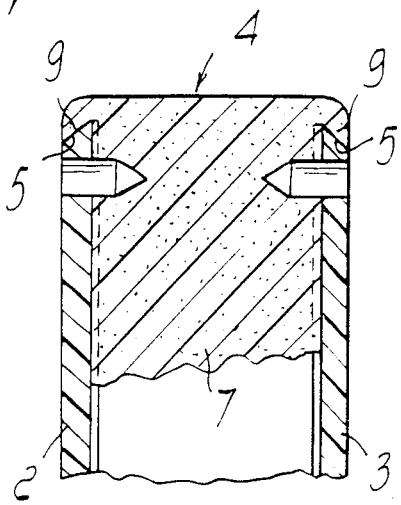
FIG. 2 is a transverse sectional view taken along the lines I—I of FIG. 1.

With reference to the above described figures, the separator structure for guiding weaving loom frames, according to the invention, is generally indicated by the reference numeral 1 and comprises a pair of plate-like elements 2 and 3 advantageously made of laminated composite material, preferably constituted by woven material and resin, by papers and by other materials, or even by a lamination of the type commercially known by the trade-name "Formica".

The plate-like elements 2 and 3 advantageously have a substantially elongated rectangular shape with rounded corners.

Said plate-like elements 2 and 3 are arranged parallel and opposite each other in spaced-apart relationship and are joined by means of an element made of plastic material which is inserted by injection molding and is constituted at least by one side member generally indicated by the reference numeral 4.

Dividing elements 7 may furthermore be advantageously provided; said elements divide the open cavity defined by the side member 4 and by the plate-like components 2 and 3 into reduced-volume chambers.

Said dividing elements 7 taper along their longitudinal extension to facilitate their separation from the mold, and their transverse cross sections define concave surfaces 11 and 12 to reduce weight while preserving a large surface for coupling to said plate-like elements.

Figure 3:
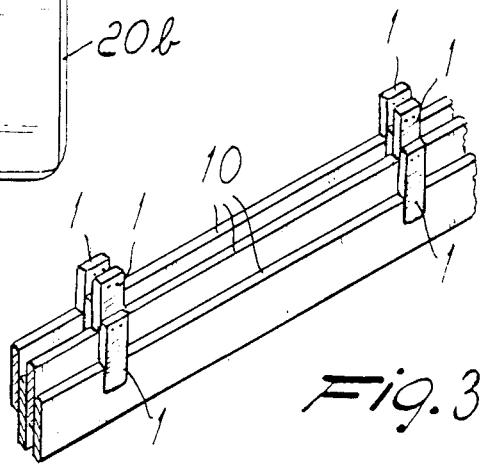
FIG. 3 is a schematic view of the application of the separators to the frames of weaving looms.
Figure 4:
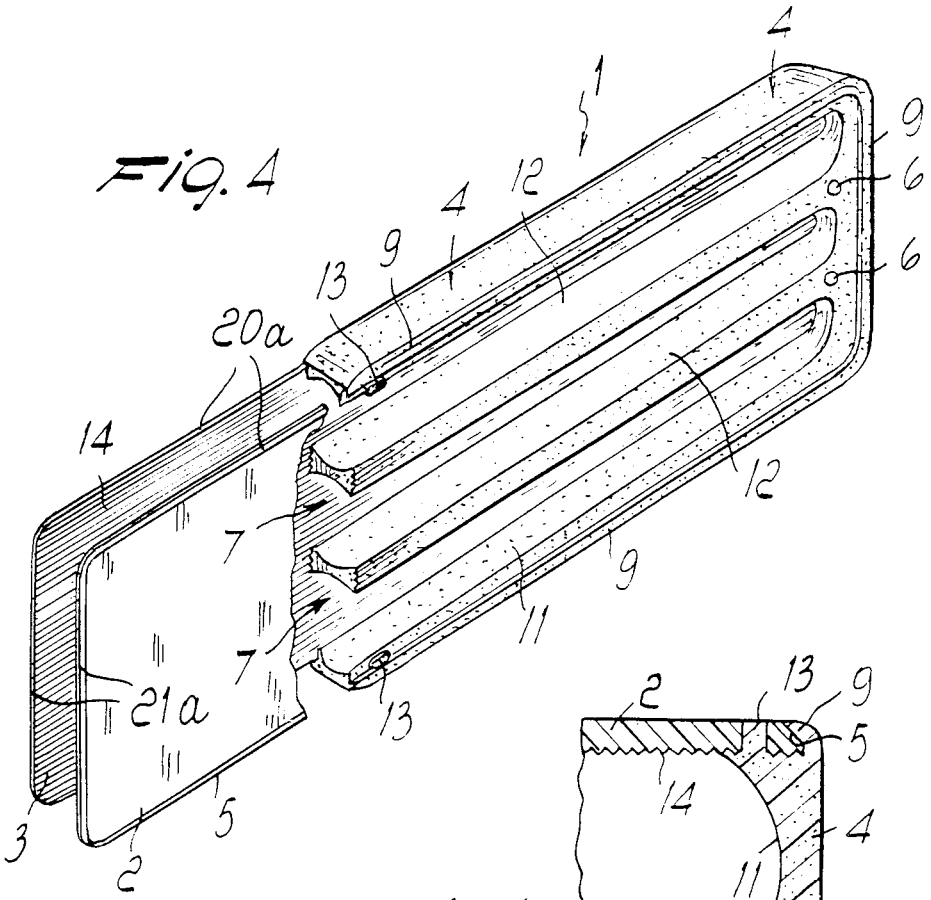
FIG. 4 is a schematic partially exploded perspective view of the separator structure according to the invention.

As is evident from the drawing, the side member 4 only affects a part of the plate-like elements, so that said plate-like elements not connected to each other for a certain part of their longitudinal extension, i.e. starting from the edge 8, and define in practice the region for coupling to the frames of the weaving loom, which are indicated by the reference numeral 10 in FIG. 3. In detail, the rectangular plate-like elements 2, 3 define two opposite long sides 20*a*, 20*b* and two opposite (lower and upper) short sides 21*a*, 21*b*, and the side member 4 extends along the upper short side 21*b* and along a portion of both opposite long sides 20*a*, 20*b* of the plate-like elements. In practice, as visible, the plate-like elements and the side member define a substantially parallelepipedal shape opened at the lower short sides 21*a* of the plate-like elements for coupling to the weaving loom frames, as above explained.

Mutual coupling means are defined by the plate-like elements 2, 3 and the side member 4 to stably connect them. According to the drawings the coupling means comprises a bevel 5 defined by the outer edge of the plate-like elements and engaged by a lip of the side member to prevent uncoupling of the plate-like elements from the side member 4 due to mutual spacing of the plate-like elements in a direction which is perpendicular to the plane defined by the plate-like elements, while the divarication of the side member 4 in a direction which is substantially parallel to the shorter sides of the rectangular plate-like elements is prevented by channels or grooves 14 defined on the opposite inner faces of the plate-like elements 2 and 3 and filled by correspondingly shaped projections of the side member 4.

Through holes 13 may furthermore be provided on the plate-like elements to increase the locking of the side member to the plate-like elements proximate to, amend "said holes provide firm locking points as they are filled by the plastic material" to read --said holes are filled by projections formed by the plastics material of the side member and thus provide firm locking points; said holes provide firm locking points as they are filled by the plastic material.

A series of holes may furthermore be provided, for example instead of the grooves 14, at the periphery of the plate-like elements at a region thereof in contact with the side member so that the introduction of the plastic material therein constitutes a divarication-preventing element.

As previously mentioned, the side member 4 and the dividing elements 7 are provided by molding a plastic material on the plate like elements, and the plate-like elements must therefore be positioned precisely in the molds; two holes, indicated by the reference numeral 6, are provided for this purpose and are engaged by centering elements constituted by pins or dowels correspondingly provided in said mold.

Figure 6:
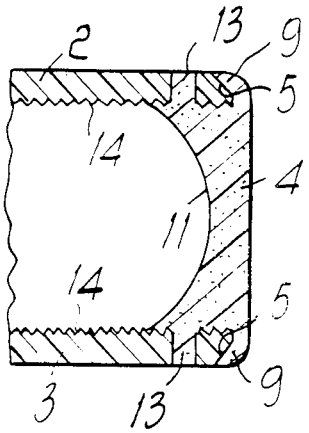
FIG. 6 is a transverse sectional view taken along the line VI—VI of FIG. 5.
Figure 5:
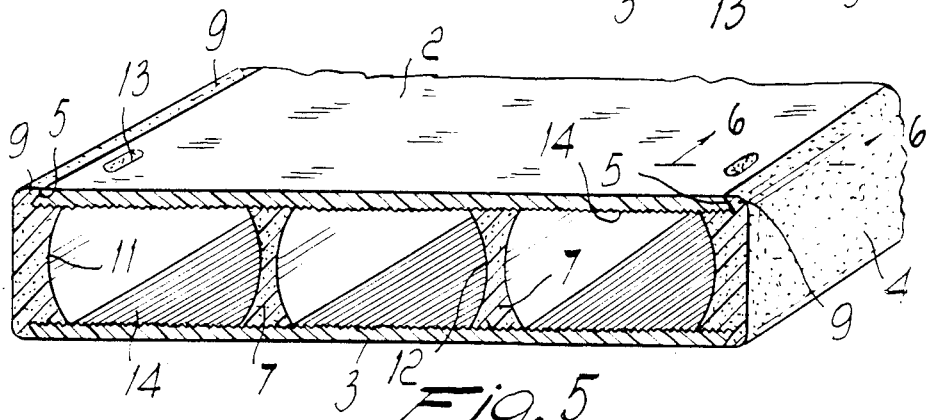
FIG. 5 is a partially cutout perspective view of the plate-like elements.

The use of the channels or grooves 14 on the plate-like elements 2 and 3, as better illustrated in the detail transverse sectional view of FIG. 6, allows to reduce or eliminate the holes 13 in the plate-like elements 2 and 3, facilitating manufacturing operations to a considerable extent.

Said dividing elements 7, besides giving further stability to the separator structure by virtue of the adhesion of the injection-molded plastic material to the grooved surface of the plate-like elements, provide a simplified and effective means for reducing the noise produced by mutual impacts during the movement of the frames avoiding the use of any sound-absorbing material, thus contributing to a further reduction and simplification of the manufacturing steps.

From what has been described above it can thus be seen that the invention achieves the intended aim and objects, and in particular the fact is stressed that a separator is provided in which the plate-like elements are obtained with a plastic lamination, therefore with a highly wear-resistant material, and that the guiding body is delimited by the side member which extends along a portion of the periphery and is monolithically connected to the dividing elements, which have a very small cross section, with the consequent advantage of obtaining a separator having a very low weight.

Another important aspect resides in the fact that the coupling between the plate-like elements and the side member is not provided by glueing but by molding the side member directly on the plate-like elements, which are correctly positioned inside the molds.

The invention thus conceived is susceptible to numerous modifications and variations, all of which are within the scope of the inventive concept.

All the details may furthermore be replaced with other technically equivalent elements.

In practice, though the best results have been obtained with the previously mentioned materials, the materials employed, as well as the dimensions and specific shapes, may be any according to requirements.

I claim:

1. A separator structure in combination with a weave loom frame, the separator structure comprising a pair of spaced-apart parallel plate-like elements defining a periphery and a separate side member extending between said plate-like elements transversely thereto along a portion of the periphery of said plate-like elements, said plate-like elements being arranged astride and being coupled to the weave loom frame, said plate-like elements and said side member defining mutually cooperating coupling means to stably couple said plate-like elements and said side member.

2. A separator structure for guiding weaving loom frames, comprising a pair of spaced-apart parallel plate-like elements defining a periphery and a separate side member extending between said plate-like elements transversely thereto along a portion of the periphery of said plate-like elements, said plate-like elements and said side member defining mutually cooperating coupling means to stably couple said plate-like elements and said side member, wherein said plate-like elements have a substantially rectangular shape defining two opposite long sides and a first and a second opposite short sides, said side member extending along said first opposite short side and along a portion of both said opposite long sides of said plate-like elements, with said plate-like elements and said side member defining a substantially parallelepipedal shape opened at said second short sides of said plate-like elements.

3. A separator structure according to claim 2, wherein said plate-like elements define therebetween an interspace accommodating a plurality of dividing elements made monolithically with said side member.

4. A separator structure according to claim 2, wherein said plate-like elements define a longitudinal direction, said plate-like elements defining therebetween an interspace accommodating a plurality of dividing elements made monolithically with said side member and extending substantially parallel to said longitudinal direction.

5. A separator structure in combination with a weave loom frame, said separator structure comprising a pair of spaced-apart parallel plate-like elements defining a periphery and mutually opposite inner faces and a separate side member extending between said plate-like elements transversely thereto along a portion of the periphery of said plate-like elements, said plate-like elements being arranged astride and being coupled to the weave loom frame, said plate-like elements defining means including a plurality of channels formed on said opposite inner faces of said plate-like elements and said side member defining means including a plurality of protrusions complementarily shaped to said channels and engaging therein, said channels and protrusions defining mutually cooperating coupling means.

6. A separator structure according to claim 5, wherein said plate-like elements define therebetween an interspace accommodating a plurality of dividing elements made monolithically with said side member.

7. A separator structure according to claim 6, wherein said plate-like elements have a substantially rectangular shape defining a longitudinal direction and said dividing elements extend from said side member substantially parallel to said longitudinal direction.

8. A separator structure according to claim 6, wherein said side member has a concave inner side facing said dividing elements, said dividing elements having concave lateral faces.

9. A separator structure according to claim 6, wherein said dividing elements have a tapering shape defining a large end at said side member.

10. A separator structure according to claim 5, wherein said mutually cooperating coupling means further comprises holes formed in said plate-like elements proximate to said perifery thereof and projections extending from said side members, said projections being complementarily shaped to said holes and engaging thereinto.

11. A separator structure according to claim 5, wherein said plate-like elements define pairs of mutually aligned centering holes.

12. A separator structure in combination with a weave loom frame, said separator structure comprising a pair of spaced-apart parallel plate-like elements defining a beveled periphery and mutually opposite inner faces and a separate side member extending between said plate-like elements transversely thereto along a portion of the periphery of said plate-like elements, said plate-like elements being arranged astride and being coupled to the weave loom frame, said plate-like elements including means defining a plurality of channels formed on said opposite inner faces of said plate-like elements and said side member including means defining a plurality of protrusions complementarily shaped to said channels and engaging therein, said side member further defining longitudinal lip portions engaging said beveled periphery of said plate-like elements to stably couple said plate-like elements to said side member.

13. A separator structure in combination with a weave loom frame, said separator structure comprising a pair of spaced-apart parallel plate-like elements defining a periphery and a separate side member extending between said plate-like elements transversely thereto along a portion of the periphery of said plate-like elements, said plate-like elements being arranged astride and being coupled to the weave loom frame, said plate-like elements including means defining a plurality of holes proximate to said periphery and said side member including means defining a plurality of projections complementarily shaped to said holes and engaging therein.

* * * * *